US006590352B1

(12) United States Patent
Wang

(10) Patent No.: US 6,590,352 B1
(45) Date of Patent: Jul. 8, 2003

(54) ELECTRICAL GROUNDING OF CRT ANTISTATIC/ANTIREFLECTIVE COATING

(75) Inventor: Shi-Sheng Wang, Taipei (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 0 days.

(21) Appl. No.: 10/135,214

(22) Filed: Apr. 30, 2002

(51) Int. Cl.[7] ..... H01J 29/72

(52) U.S. Cl. ..... 315/364; 315/370; 313/447 R

(58) Field of Search ..... 315/364, 370, 315/375, 376, 382; 313/447, 448, 461, 480, 447 R

(56) References Cited

U.S. PATENT DOCUMENTS

| | | | | | |
|---|---|---|---|---|---|
| 2,852,415 | A | | 9/1958 | Colbert et al. | 117/211 |
| 2,977,412 | A | | 3/1961 | Rhodes et al. | 178/7.85 |
| 4,468,702 | A | | 8/1984 | Jandrell | 358/245 |
| 4,563,612 | A | | 1/1986 | Deal et al. | 313/478 |
| 4,585,976 | A | * | 4/1986 | Reed | 315/364 |
| 4,695,045 | A | | 9/1987 | Chase et al. | 269/152 |
| 4,720,282 | A | | 1/1988 | Chase et al. | 445/52 |
| 4,785,217 | A | | 11/1988 | Matsuda et al. | 313/479 |
| 4,987,338 | A | | 1/1991 | Itos et al. | 313/478 |
| 5,025,490 | A | | 6/1991 | Tamura | 313/479 |
| 5,051,652 | A | | 9/1991 | Isomura et al. | 313/479 |
| 5,099,171 | A | | 3/1992 | Daiku et al. | 313/479 |
| 5,200,667 | A | | 4/1993 | Iwasaki et al. | 313/478 |
| 5,523,649 | A | | 6/1996 | Tong et al. | 313/479 |
| 5,580,662 | A | | 12/1996 | Tong et al. | 428/432 |
| 5,652,477 | A | | 7/1997 | Tong et al. | 313/479 |
| 5,773,150 | A | | 6/1998 | Tong et al. | 428/429 |
| 5,783,049 | A | | 7/1998 | Bright et al. | 204/192.14 |
| 5,879,217 | A | * | 3/1999 | Saito et al. | 445/23 |
| 6,353,283 | B1 | * | 3/2002 | Ghosh et al. | 313/477 R |
| 6,465,947 | B1 | * | 10/2002 | Tojo et al. | 313/478 |

* cited by examiner

*Primary Examiner*—Don Wong
*Assistant Examiner*—Jimmy T. Vu
(74) *Attorney, Agent, or Firm*—Emrich & Dithmar

(57) ABSTRACT

The coating on the outer surface the display screen of a cathode ray tube (CRT) includes an inner conductive antistatic layer and an outer antireflective layer. When applied by a wet coating method, e.g., spray or spin coating, the two layers diffuse into one another to form a composite layer. When applied by a dry coating method, e.g., sputtering, the two layers remain separate. In the former case, a layer of conductive carbon black is applied between the composite layer and the CRT's tension (or implosion protection) band, while in the later case the conductive carbon black layer is applied between the tension band and a conductive element applied to the inner antistatic layer. The carbon black layer provides a conductive path to ground for the display screen's outer coating to prevent electrostatic charge buildup on the display screen.

14 Claims, 5 Drawing Sheets

ELECTRICAL GROUNDING OF CRT ANTISTATIC/ANTIREFLECTIVE COATING

FIELD OF THE INVENTION

This invention relates generally to cathode ray tubes (CRTs) and is particularly directed to an arrangement for preventing the buildup of electrostatic charge on the display screen of a CRT by directing the charge to neutral ground.

BACKGROUND OF THE INVENTION

CRTs operate at high voltages causing the glass display screen, or faceplate, surface of the CRT to become electrically charged by static induction. The static electricity attracts dust and other contaminates in the air causing them to collect on the display screen's outer surface which degrades the video image presented on the display screen. When a person touches the CRT's display screen, he or she may receive a slight shock by discharge of the static electricity, particularly under relatively low humidity conditions. In addition to being unpleasant to the touch, this static discharge may disrupt the operation of other electronic equipment located nearby such as a computer when the CRT is employed in a computer terminal. Other types of self-emitting video displays such as liquid crystal displays (LCDs), plasma discharge displays (PDPs), vacuum flourescent screens, and gas discharge screens also suffer from the aforementioned problems. The buildup of static charge on the faceplate of a video display arises because of the dielectric nature of glass. In addressing problems arising from static electricity buildup on the display screen, an electrically conductive antistatic coating is typically applied to the outer surface of the display screen and is coupled to neutral ground for dissipating static charge on the display screen's outer surface.

The outer surface of the CRT's display screen reflects approximately 4–8% of the light incident on the display screen. This reflected light not only degrades video image resolution and contrast, but also causes viewer eye fatigue. To reduce this light reflection and improve video image viewing, an outer antireflective layer, or layers, is deposited on the display screen's inner antistatic layer. In some cases, the antireflective and antistatic layers are mixed together to form a single solution which is applied to the display screen's outer surface as a single layer coating. Even when the antistatic and antireflective layers are sequentially deposited on the display screen, there is to some extent fusion between the two layers, particularly when the layers are applied by a wet coating method such as by spray or spin coating.

To avoid the problems of static charge buildup on the display screen, the display screen's conductive antistatic layer is typically connected to neutral ground for dissipating this charge. One approach to grounding the display screen's outer surface coating using the CRT's implosion protection, or tension band is disclosed in U.S. Pat. No. 5,025,490 and involves the application of an electrical conductive tape to the outer layer of the 2-layer coating and attaching the conductive tape to the grounded implosion protection band. The electrically conductive tape used in this application is rather expensive and cannot be used where the antireflective layer is separate from and covers the antistatic layer such as when the coating is applied by sputtering.

Referring to FIG. 1, there is shown a typical prior art installation for electrically grounding the glass display screen 14 of a CRT 10. In the following discussion, common elements in the various arrangements are described with the same terminology and have assigned the same element identifying number. In addition, the terms "display screen," "display panel" and "faceplate" are used interchangeably as are the terms "layer" and "coating". CRT 10 includes a sealed glass envelope 12 having a rear neck portion 18, an intermediate funnel portion 16, and the aforementioned glass display screen 14 on a forward portion thereof. Disposed within the CRT 10 are one or more electron guns (not shown for simplicity), each of which directs a respective electron bean on the inner surface of the glass display screen 14. Disposed on the inner surface of the glass display screen 14 is a phosphor screen (also not shown) which includes plural discreet phosphor deposits, or elements, which emit light when an electron beam is incident thereon to produce a video image on the display screen. Disposed about the outer periphery of the sealed glass envelope 12 is an implosion protection, or tension, band 70 typically comprised of a high strength, electrically conductive material such as steel. Attached to respective corners of the outer periphery of the implosion protection band 70 are first, second, third, and fourth band ears 28*a*–28*d*. Each of the band ears 28*a*–28*d* is securely attached to the outer surface of the implosion protection band 70 by conventional means such as weldments. The band ears 28*a*–28*d* are used for mounting the CRT 10 in a chassis which is not shown in the figure. Disposed on the outer surface of the glass display screen 14 is a composite antistatic/antireflective coating 52. The composite antistatic/antireflective coating 52 may be in the form of a single layer or in the form of an inner antistatic layer applied directly to the glass display screen 14 and an outer antireflective layer applied over the inner antistatic layer. The composite antistatic/antireflective coating 52 is electrically conductive, as is the antistatic layer in the case of the two-layer coating.

FIG. 2 is a simplified sectional view of a corner of the CRT's sealed glass envelope 12 showing a single composite antistatic/antireflective coating 52 such as produced by a wet coating application, i.e., a spray or spin coating, on the outer surface of the CRT's glass display screen 14. In the wet coating process, there is typically diffusion between the antistatic and antireflective layers to produce a composite coating comprised of molecules 51 arranged in a staggered array. In the two-layer arrangement as shown in FIG. 3, an inner antistatic layer 46 is maintained separate from an outer antireflective layer 48 on the outer surface of the CRT's glass display screen 14. The separate inner antistatic layer 46 and outer antireflective layer 48 are typically applied using a dry coating method such as by sputtering. In both cases, the prior approach involves grounding the antistatic/antireflective coating by electrically coupling it to the CRT's implosion protection band 70 which is connected to neutral ground by means of a grounded connection 44 (shown in dotted line form). In the case of the composite antistatic/antireflective coating 52 shown in FIG. 2, an edge of the outer surface of the composite antistatic/antireflective coating is electrically coupled to the implosion protection band 70 by means of a strip of conductive aluminum tape 50. Applied over the conductive aluminum tape 50 is a plastic film of conductive aluminum foil 60 having an adhesive backing 60*b* for adhesion to the outer surface of the conductive aluminum tape. This arrangement is also shown in the perspective view of FIG. 1. In the case of the two-layer arrangement comprising the inner antistatic layer 46 and the outer antireflective layer 48, the conductive aluminum tape 50 is applied to an outer edge of the outer antireflective layer as well as the CRT's implosion protection band 70. A plastic film of conductive aluminum foil 60 is placed over the conductive aluminum tape 50 as in the previously described arrangement. Because the outer antireflective layer 48 is not as good a conductor as the inner antistatic layer 46, the grounding arrangement shown in FIG. 3 is not as effective in grounding an electrostatic charge which may be present on the display screen as the arrangement shown in FIG. 2 for the composite antistatic/antireflective coating 52. In order to improve the grounding capability of the arrangement shown in FIG. 3, a conductive element 55 is sometimes formed on the outer surface of the inner antistatic layer 46 so as to extend through the outer antireflective layer 48 as shown in FIG. 4. Conductive element 55 reduces the electrical resistance between the antistatic layer 46 and the conductive aluminum tape 50. Conductive element 55 is typically comprised of a conductive metal and is formed by conventional means such as ultra-sonic spot welding.

The conductive aluminum tape used in the grounding arrangements described above and shown in FIGS. 1–4 is relatively expensive and thus increases the manufacturing cost of the CRT. In addition, the conductive aluminum tape is typically applied by hand by a worker which further increases CRT manufacturing cost.

The present invention addresses the aforementioned limitations of the prior art by providing for the electrical grounding of an antistatic/antireflective coating on the outer surface of a CRT's display screen by applying a layer of conductive carbon black between the antistatic/antireflective coating and the CRT's grounded implosion protection band. The inventive electrical grounding of the antistatic/antireflective coating is applicable to either a single composite antistatic/antireflective coating applied by a wet coating process as well as to the combination of an inner antistatic layer and an outer antireflective layer such as applied by a dry coating process in providing a highly reliable, low cost approach to static charge dissipation on the CRT's display screen.

OBJECTS AND SUMMARY OF THE INVENTION

Accordingly, it is an object of the present invention to direct electrostatic charge on the outer surface of a display screen of a CRT to neutral ground.

It is another object of the present invention to increase CRT viewer safety by preventing electric shock to the viewer and to reduce electrostatic interference with the operation of other electronic devices caused by electrostatic charge buildup on the CRT's display screen.

Yet another object of the present invention is to improve viewing of a video image on the display screen of a CRT by reducing the deposit of dust particles and other contaminants on the screen due to the presence of an electrostatic charge on the screen.

A still further object of the present invention is to provide an arrangement for grounding an antistatic/antireflective coating applied to the outer surface of a CRT display screen by spray coating, spin coating or sputtering.

These objects of the present invention are achieved and the disadvantages of the prior art are overcome in a CRT having a sealed glass envelope with a glass display screen whereon is presented a video image produced by plural electron beams incident upon a light emitting coating disposed on an inner surface of said glass display screen, and wherein an electrostatic charge is produced on the display screen by the electron beams incident thereon, by an arrangement for dissipating the electrostatic charge comprising a grounded implosion protection band disposed about and engaging an outer surface of the sealed glass envelope; an electrically conductive antistatic/antireflective coating disposed on an outer surface of the glass display screen for receiving an electrostatic charge on and reducing light reflection from the glass display screen; and a conductive carbon black layer disposed on a corner of the glass envelope and coupling the antistatic/antireflective coating to the implosion protection band for directing an electrostatic charge on the display screen to neutral ground.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
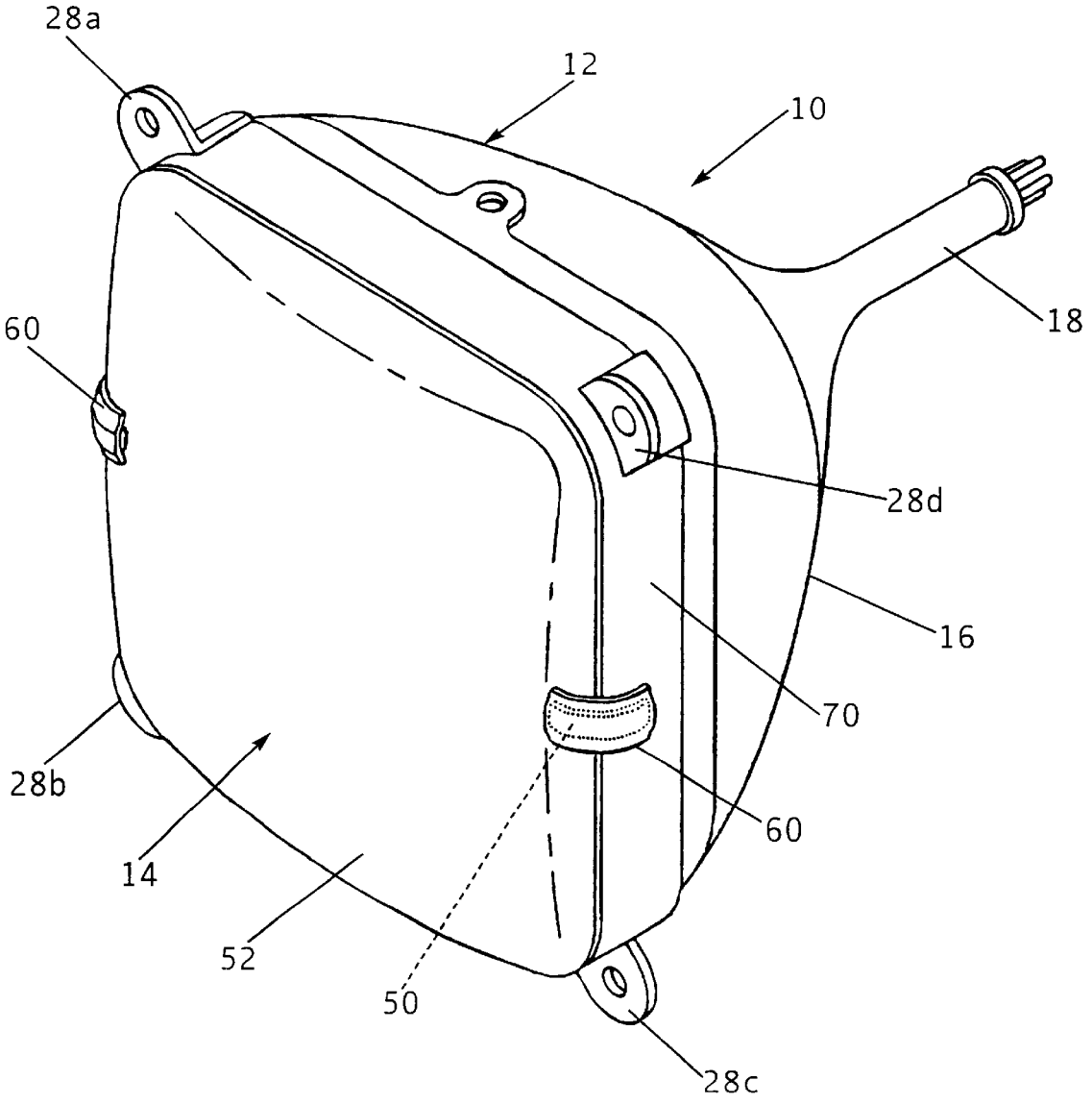
FIG. 1 (PRIOR ART)
FIG. 1 is a perspective view of a CRT incorporating a prior art electrical grounding arrangement for directing an electrostatic charge on the CRT's glass display screen to neutral ground.
Figure 2:
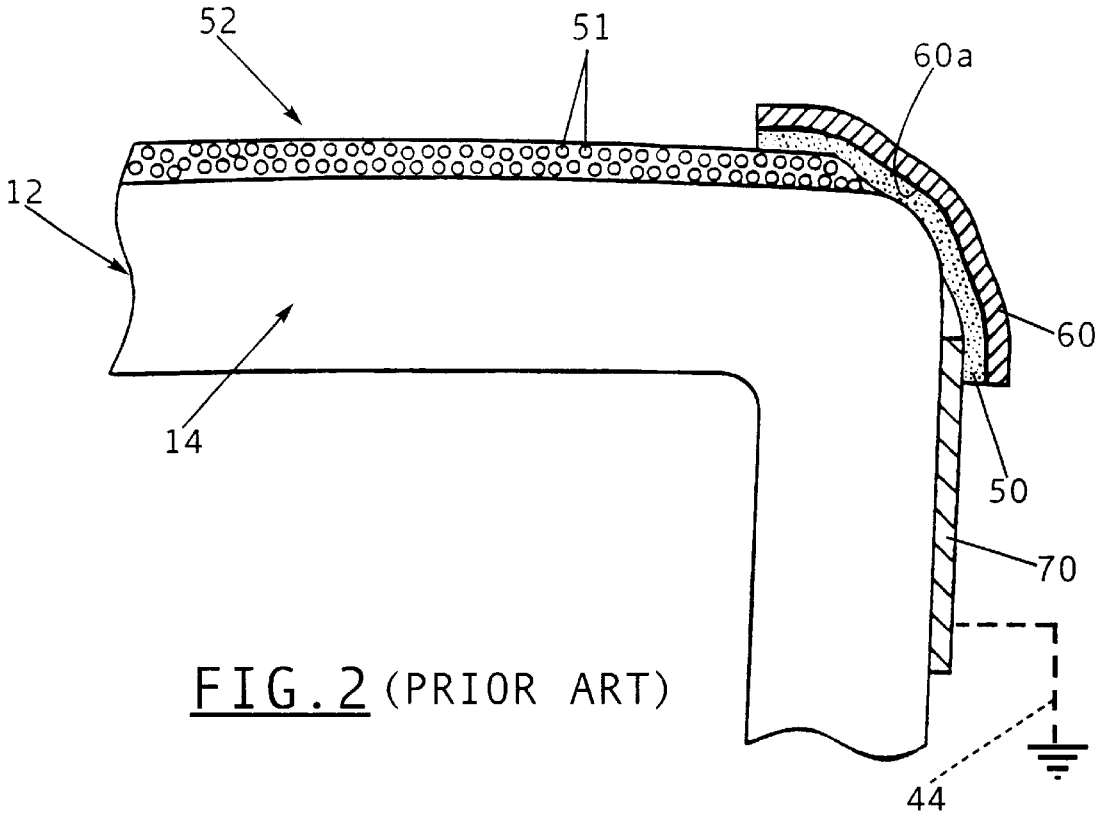
FIG. 2 (PRIOR ART)
FIG. 2 is a partial sectional view of a portion of the CRT of FIG. 1 showing details of the prior art ground arrangement for a composite antistatic/antireflective layer disposed on the outer surface of the CRT's display screen.
Figure 3:
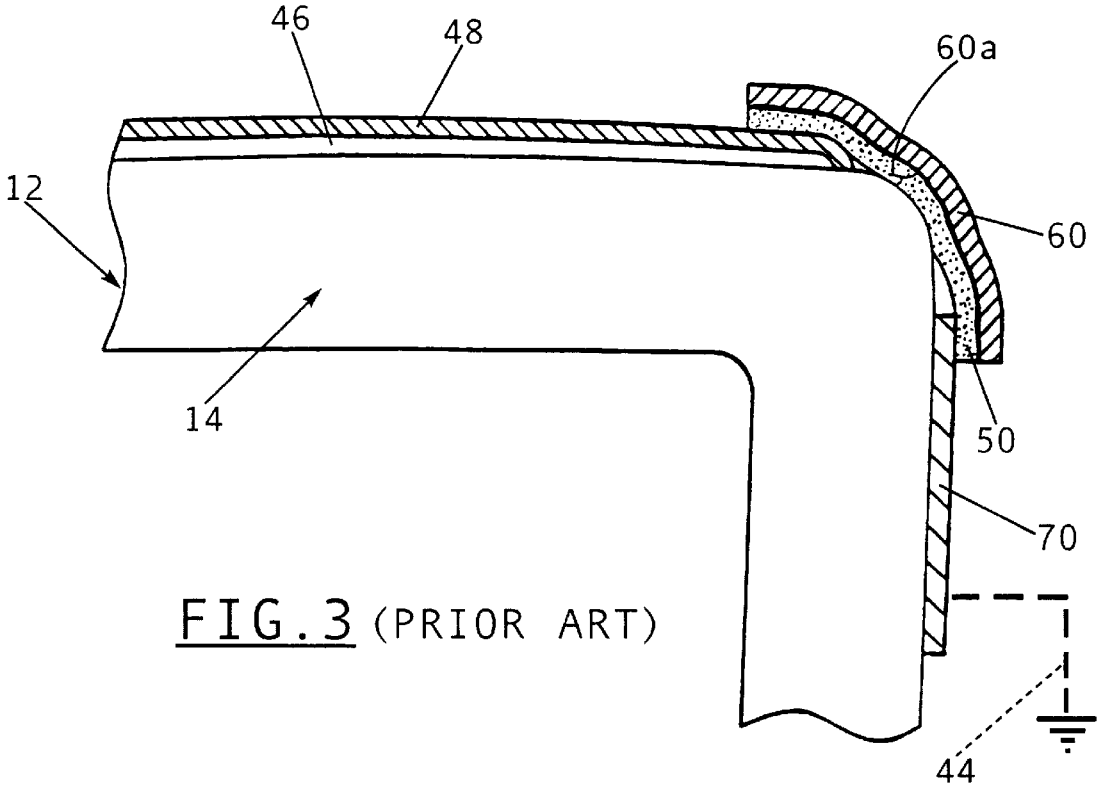
FIG. 3 (PRIOR ART)
FIG. 3 is a partial sectional view of a portion of a CRT showing details of the prior art grounding arrangement for the combination of an inner antistatic layer and an outer antireflective layer disposed on the outer surface of the CRT's display screen.
Figure 4:
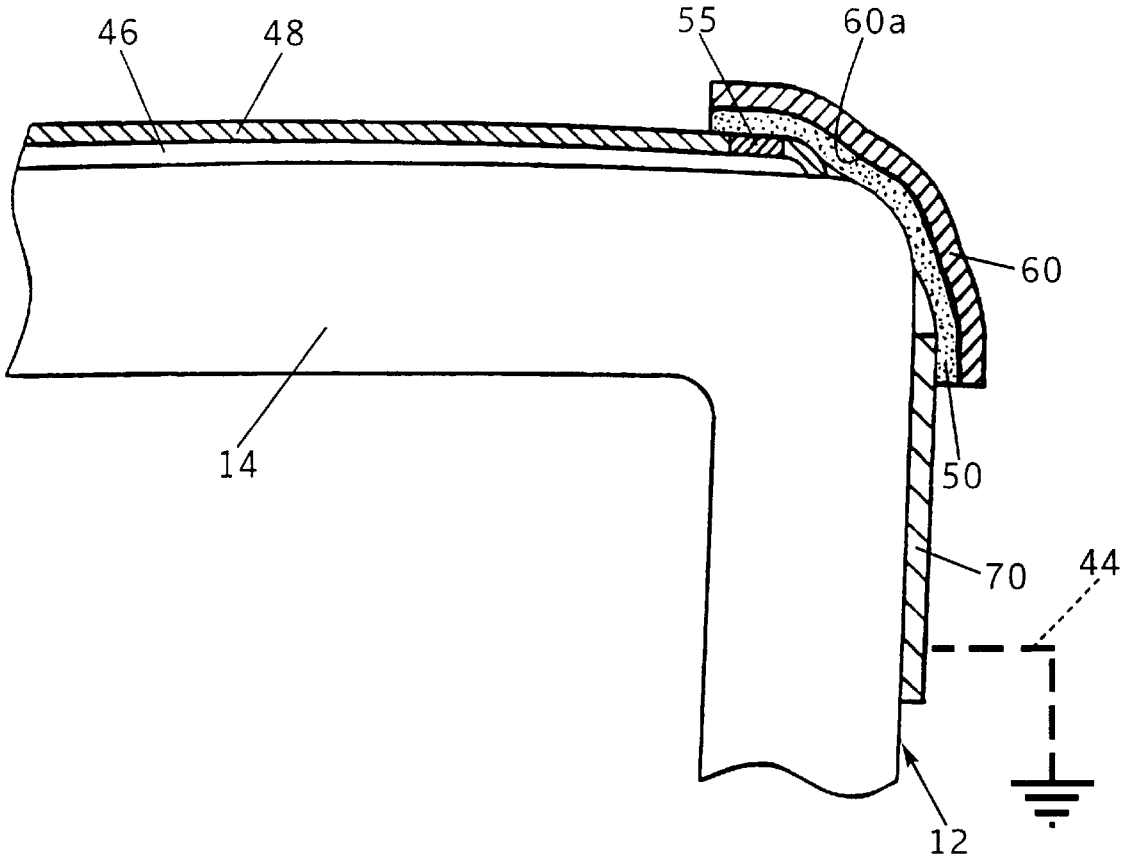
FIG. 4 (PRIOR ART)
FIG. 4 is a partial sectional view of a portion of a CRT showing details of another embodiment of a prior art grounding arrangement for the combination of an inner antistatic layer and an outer antireflective layer disposed on the outer surface of the CRT's display screen.
Figure 5:
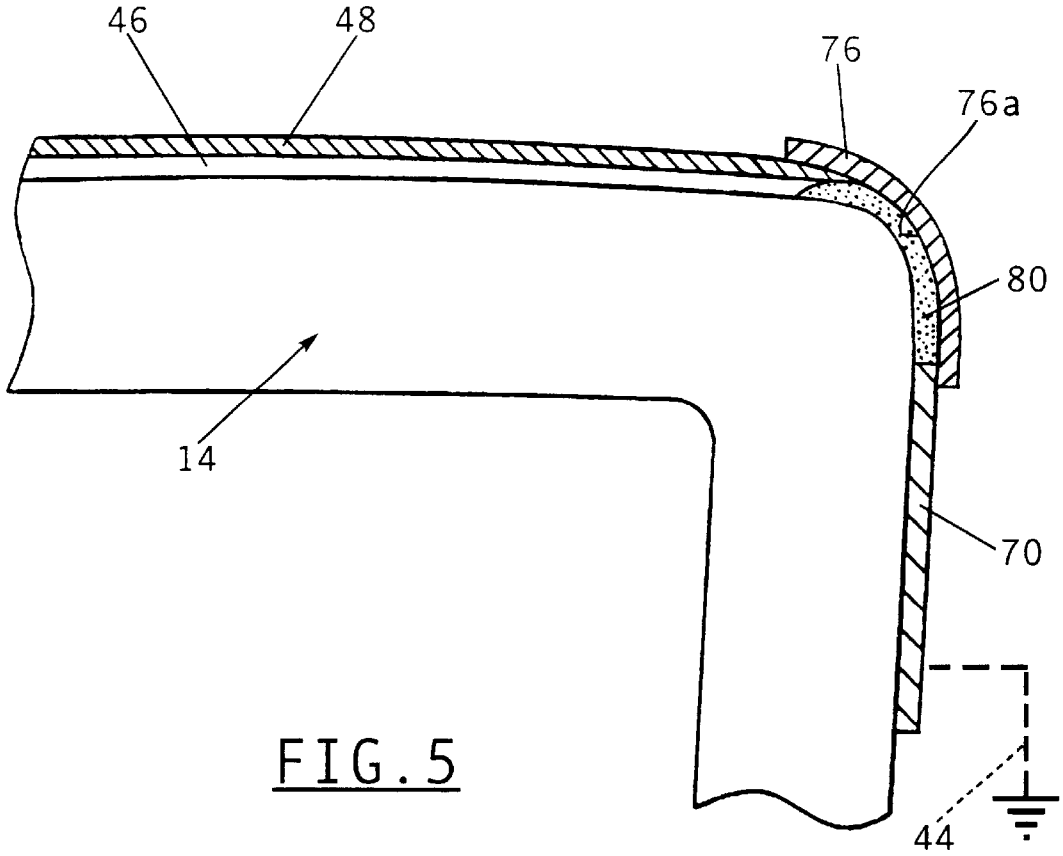
FIG. 5 is a partial sectional view of a portion of the glass envelope of a CRT showing an electrical grounding arrangement for the combination of an inner antistatic layer and an outer antistatic layer disposed on the outer surface of the CRT's display screen in accordance with one embodiment of the present invention.

Referring to FIG. 5, there is shown an arrangement for directing electrostatic charge buildup on the outer surface of a CRT's glass display screen 14 to neutral ground in accordance with the present invention. In the grounding arrangement shown in FIG. 5, a layer of conductive carbon black 80 is first applied to a corner of the CRT's glass display screen 14 about the outer periphery of the CRT's sealed glass envelope 12. An inner antistatic layer 46 is then applied by a conventional method such as sputter deposition to the outer surface of the CRT's glass display screen 14. An edge of the inner antistatic layer 46 is disposed in contact with the layer of conductive carbon black 80 on the corner of the sealed glass envelope 12. An outer antireflective layer 48 is then deposited on the inner antistatic layer 46 also by a conventional method such as sputter deposition. The outer antireflective layer 48 covers the inner antistatic layer 46 and extends to the corner of the sealed glass envelope 12 so as to cover the area of contact between the inner antistatic layer and the layer of conductive carbon black 80. A strip of electrically conductive aluminum foil 76 having an adhesive backing 76*a* is then applied to the surface of the layer of conductive carbon black 80. The conductive aluminum foil 76 is disposed on the outer surface of the layer of conductive carbon black 80 and extends between the outer antireflective layer 48 and the implosion protection band 70. The conductive aluminum foil 76 serves as a protective insulator for the layer of conductive carbon black 80 and also increases the electrical coupling between the inner antistatic layer 46 and the implosion protection band 70 for directing electrostatic charge on the CRT's glass display screen 14 to neutral ground via grounded connection 44.

Figure 6:
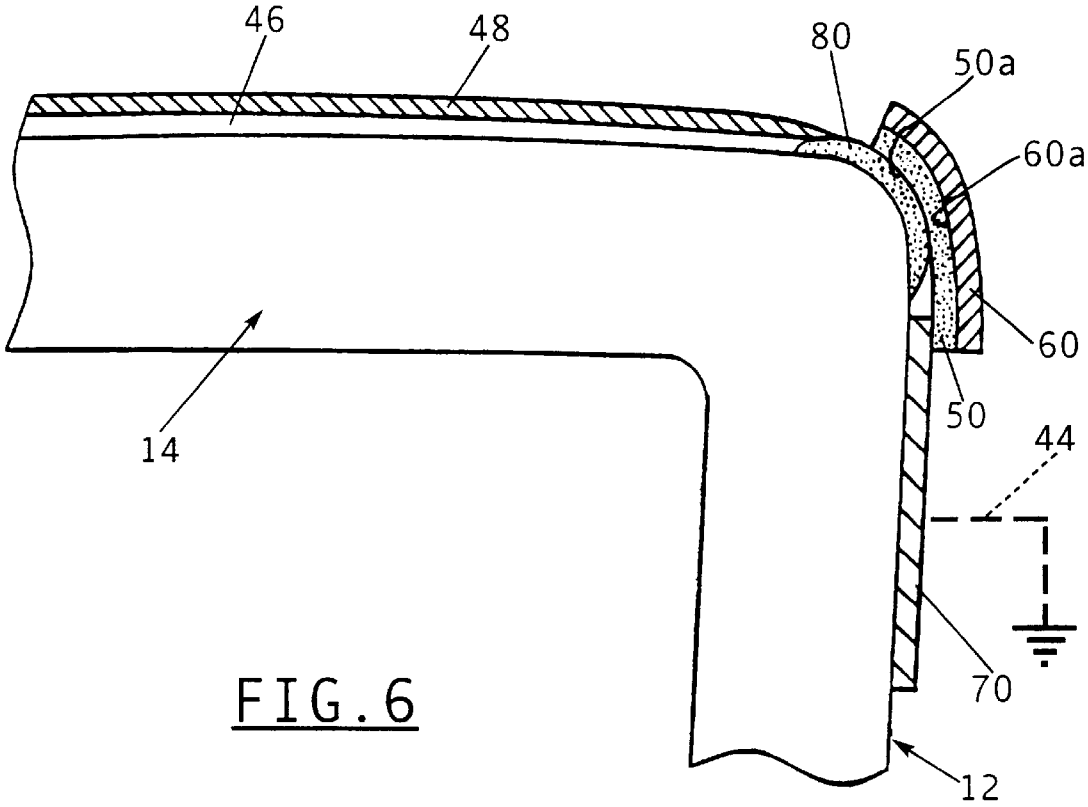
FIG. 6 is a partial sectional view of a portion of the glass envelope of a CRT showing another embodiment of an electrical grounding arrangement for the combination of an inner antistatic layer and an outer antireflective layer disposed on the outer surface of the CRT's display screen in accordance with another embodiment of the present invention.

Referring to FIG. 6, there is shown another arrangement for directing electrostatic charge built up on the outer surface of the CRT's glass display screen 14 to neutral ground in accordance with the present invention. In the grounding arrangement shown in FIG. 6, the layer of conductive carbon black 80 applied to the corner of the outer surface of the CRT's sealed glass envelope 12 does not extend the full distance between the inner antistatic layer 46 and the CRT's implosion protection band 70. In this grounding arrangement, a combination of an inner strip of conductive aluminum tape 50 and an outer strip of conductive aluminum foil 60 is applied to and extends between the layer of conductive carbon black 80 and the CRT's implosion protection band 70. As in the previously described embodiment, the inner surfaces of the conductive aluminum tape 50 and the conductive aluminum foil 60 are provided with respective adhesive backings 50*a* and 60*a*. This allows the inner conductive aluminum tape 50 to be securely affixed to the layer of conductive carbon black 80 and the implosion protection band 70, and the outer conductive aluminum foil 60 to be securely affixed to the inner conductive aluminum tape. The inner conductive aluminum tape 50 provides a conductive path between the layer of conductive carbon black 80 and the implosion protection band 70 to complete the conductive path between the inner antistatic layer 46 and the implosion protection band. The outer conductive aluminum foil 60 provides physical protection and electrical insulation for the inner conductive aluminum tape 50.

Figure 7:
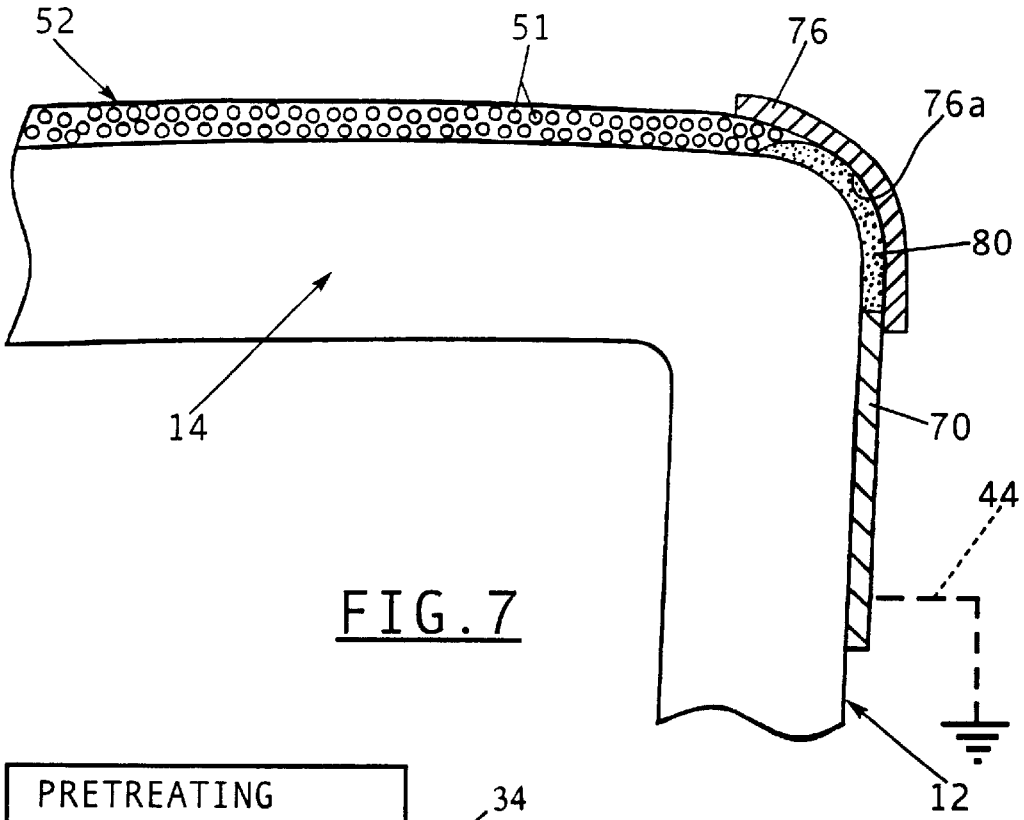
FIG. 7 is a partial sectional view of a portion of the glass envelope of a CRT showing an electrical grounding arrangement for a single composite antistatic/antireflective coating disposed on the outer surface of the CRT's display screen in accordance with another embodiment of the present invention.

Referring to FIG. 7, there is shown a partial sectional view of the glass envelope 12 of a CRT showing an electrical grounding arrangement in accordance with the present invention for grounding a composite antistatic/antireflective coating 52 disposed on the outer surface of the CRT's glass display screen 14. As described earlier, the composite antistatic/antireflective coating 52 includes an array of staggered molecules 51 in a single layer coating which is electrically conductive as well as antireflective. After a layer of conductive carbon black 80 is deposited on the outer edge of the CRT's sealed glass envelope 12 and in contact with its implosion protection band 70, the composite antistatic/antireflective coating 52 is deposited on the outer surface of the glass display screen 14 by conventional means such as spin or spray coating. The composite antistatic/antireflective coating 52 is disposed an intimate contact with an edge of the layer of conductive carbon black 80 so as to provide a continuous electrically conductive path between the composite antistatic/antireflective coating and the grounded implosion protection band 70. A strip of conductive aluminum foil 76 having an adhesive backing 76*a* is placed in intimate contact with the layer of conductive carbon black 80 and adjoining portions of the composite antistatic/antireflective coating 52 and the implosion protection band 70. The aluminum foil's adhesive backing 76*a* provides secure attachment of the aluminum foil 76 to the composite antistatic/antireflective coating 52, the layer of conductive carbon black 80, and the implosion protection band 70.

Figure 8:
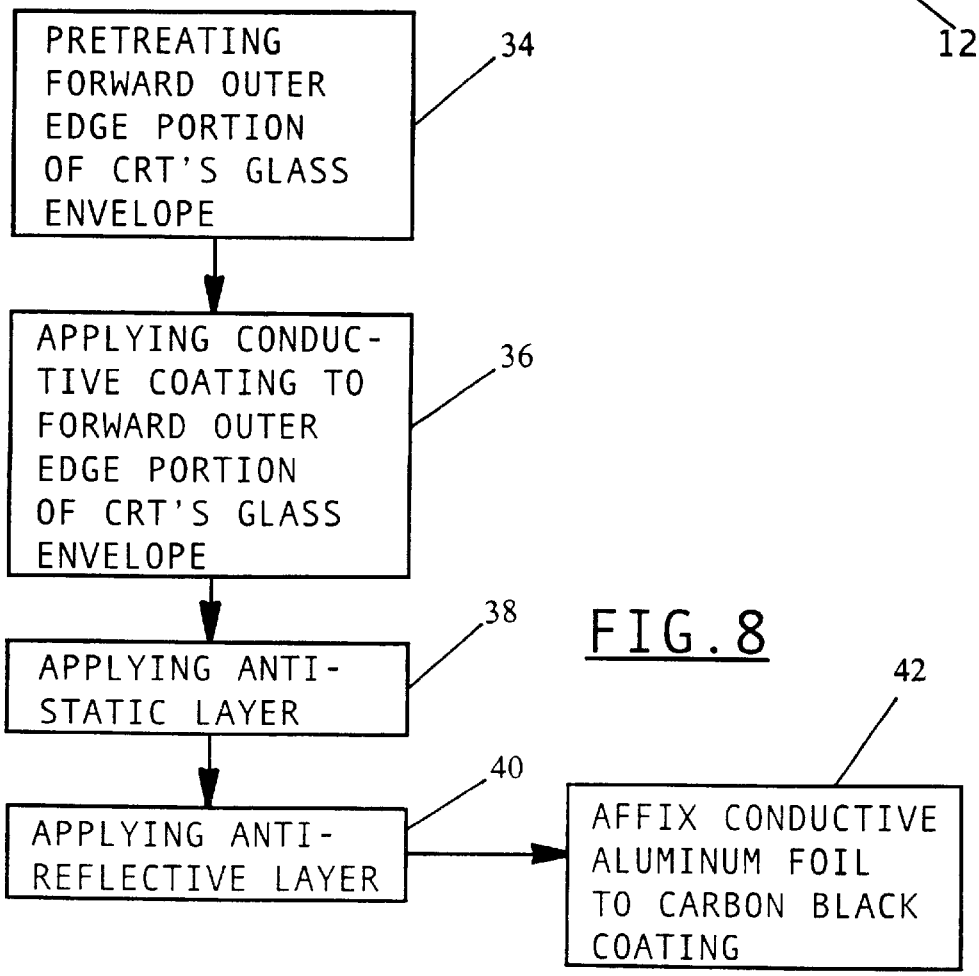
FIG. 8 is a simplified flow chart illustrating the series of steps involved in providing for the grounding of an electrostatic charge on the display screen of a CRT in accordance with the present invention.

Referring to FIG. 8, there is shown a simplified flowchart illustrating the series of steps involved in applying an electrical grounding arrangement to the sealed glass envelope of a CRT in accordance with the principles of the present invention. At step 34, the forward outer edge portion of the CRT's sealed glass envelope is treated with a cleaning agent and a suitable material for preparing the sealed glass envelope for receiving and adhering to an inner antistatic layer and a layer of conductive carbon black. At step 36, the layer of conductive carbon black is applied to the forward outer edge portion of the CRT's sealed glass envelope. The layer of conductive carbon black is disposed on the sealed glass envelope in contact with the CRT's implosion protection band. An antistatic layer is then applied to the outer surface of the CRT's glass display screen at step 38. At step 40, an outer antireflective layer is then applied over the inner antistatic layer and the adjoining portion of the layer of conductive carbon black. A strip of conductive aluminum foil is then at step 42 positioned over the layer of conductive carbon black and extends in an overlapping manner to portions of the outer antireflective layer and the implosion protection band disposed adjacent the layer of conductive carbon black.

While particular embodiments of the present invention have been shown and described, it will be obvious to those skilled in the relevant art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. For use in a CRT having a sealed glass envelope with a glass display screen whereon is presented a video image produced by plural electron beams incident upon a light emitting coating disposed on an inner surface of said glass display screen, and wherein an electrostatic charge is produced on said display screen by said electron beams incident thereon, an arrangement for dissipating said electrostatic charge comprising:

a grounded implosion protection band disposed about and engaging an outer surface of the sealed glass envelope;

an electrically conductive antistatic/antireflective coating disposed on an outer surface of the glass display screen for receiving an electrostatic charge on and reducing light reflection from said glass display screen; and a conductive carbon black layer disposed on a corner of the glass envelope and coupling said antistatic/antireflective coating to said implosion protection band for directing an electrostatic charge on the display screen to neutral ground.

2. The arrangement of claim 1 further comprising a conductive metal foil member affixed to an outer surface of said carbon black layer for physically protecting said carbon black layer and providing an additional current path between said antistatic/antireflective coating and said implosion protection band.

3. The arrangement of claim 2 wherein said conductive metal foil member extends between said antistatic/antireflective coating and said implosion protection band and completely covers said carbon black layer.

4. The arrangement of claim 3 wherein said conductive metal foil member includes aluminum.

5. The arrangement of claim 1 wherein said carbon black layer extends part of the distance between said antistatic/antireflective coating and said implosion protection band, and wherein said arrangement further includes conductive metal tape affixed to and extended between said carbon black layer and either said antistatic/antireflective coating or said implosion protection band.

6. The arrangement of claim 5 further comprising a conductive foil member affixed to an outer surface of said conductive metal tape for physically protecting said conductive metal tape and providing an additional current path between said carbon black layer and either said antistatic/antireflective coating or said implosion protection band.

7. The arrangement of claim 6 wherein said conductive metal tape and said conductive foil member each include aluminum.

8. The arrangement of claim 1 wherein said antistatic/antireflective coating comprises an electrically conductive inner antistatic layer disposed on the outer surface of the glass display screen and an outer antireflective layer disposed on said inner antistatic layer, and wherein said carbon black layer electrically couples said inner antistatic layer to said implosion protection band.

9. The arrangement of claim 8 further comprising a conductive metal foil member affixed to an outer surface of said carbon black layer for physically protecting said carbon black layer and providing an additional current path between said inner antistatic layer and said implosion protection band.

10. The arrangement of claim 9 wherein said conductive metal foil member extends between said inner antistatic layer and said implosion protection band and completely covers said carbon black layer.

11. The arrangement of claim 10 wherein said conductive metal foil member includes aluminum.

12. The arrangement of claim 8 wherein said carbon black layer extends part of the distance between said inner antistatic layer and said implosion protection band, said arrangement further comprising a conductive metal tape affixed to and extended between said carbon black layer and either said inner antistatic layer or said implosion protection band.

13. The arrangement of claim 12 further comprising a conductive foil member affixed to an outer surface of said conductive metal tape for physically protecting said conductive metal tape and providing an additional current path between said carbon black layer and either said inner antistatic layer or said implosion protection band.

14. The arrangement of claim 13 wherein said conductive metal foil and said conductive metal tape each includes aluminum.

* * * * *